US009575437B2

(12) United States Patent
Oba et al.

(10) Patent No.: US 9,575,437 B2
(45) Date of Patent: Feb. 21, 2017

(54) IMAGE FORMING APPARATUS HAVING WIDTHWISE ADJUSTMENT OF ENDLESS BELT

(71) Applicant: CANON KABUSHIKI KAISHA, Tokyo (JP)

(72) Inventors: Katsuhiko Oba, Odawara (JP); Takeo Kawanami, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/966,488

(22) Filed: Dec. 11, 2015

(65) Prior Publication Data

US 2016/0170336 A1 Jun. 16, 2016

(30) Foreign Application Priority Data

Dec. 11, 2014 (JP) ..... 2014-251319

(51) Int. Cl.
*G03G 15/16* (2006.01)

(52) U.S. Cl.
CPC ..... *G03G 15/1605* (2013.01)

(58) Field of Classification Search
CPC ..... G03G 15/755; G03G 2215/1623; G03G 15/1605; G03G 15/1615
See application file for complete search history.

(56) References Cited

U.S. PATENT DOCUMENTS

2002/0034400 A1* 3/2002 Asuwa ..... G03G 15/1605 399/165
2008/0310891 A1* 12/2008 Mochizuki ..... G03G 15/0131 399/302
2010/0310286 A1* 12/2010 Yasumoto ..... G03G 15/0131 399/302
2012/0328337 A1* 12/2012 Hiratsuka ..... G03G 15/1615 399/302

FOREIGN PATENT DOCUMENTS

JP 09-160393 A 6/1997
JP 11-116089 A 4/1999
JP 2008/058560 A 3/2008
JP 2014/105105 A 6/2014

* cited by examiner

*Primary Examiner* — Sandra Brase
(74) *Attorney, Agent, or Firm* — Fitzpatrick, Cella, Harper & Scinto

(57) ABSTRACT

An image forming apparatus includes a toner image carrying drum; and an image transfer unit including an endless belt, first and second belt stretching rollers, and an adjusting unit for adjusting belt movement in a widthwise direction by inclining the first roller relative to the second roller. The adjusting unit includes a contacting member provided between the first roller and the drum and contacting with an inner surface of the belt. The contacting member contacts the inner surface of the belt at a position in a drum side across a common internal tangent between the drum and such a portion of a surface of the first roller as is moved closest to the drum by the adjusting unit, the common internal tangent being the one contacting a portion of the (Continued)

drum adjacent to a drum-belt contact position and contacting a portion of the first roller adjacent to a first-roller-belt contact position.

11 Claims, 9 Drawing Sheets

(a)

(b)

(c)

Prior Art

IMAGE FORMING APPARATUS HAVING WIDTHWISE ADJUSTMENT OF ENDLESS BELT

FIELD OF THE INVENTION AND RELATED ART

The present invention relates to a transfer unit which has an endless belt and multiple components by which the endless belt is suspended and kept tensioned, and which circularly moves the endless belt. It relates to also an image forming apparatus such as a printer, a copying machine, and a facsimile machine, which are equipped with the transfer unit.

Generally speaking, some image forming apparatuses such as printers and copying machines which use an electrophotographic image forming method, for example, are equipped with a transfer unit, which has an endless belt and multiple components by which the endless belt is suspended and kept tensioned, and which circularly moves the endless belt. Further, some transfer units are equipped with an intermediary transferring component for transferring (secondary transfer) a toner image onto a sheet of transfer medium, such as a sheet of recording paper, after the transfer (primary transfer) of the toner image onto the intermediary transferring component, or a belt, as a transfer medium bearing component which bears and conveys a sheet of transfer medium onto which a toner image is transferred from an image bearing component. Transfer units such as those described above form a transfer nip (transferring section), which is the area of contact between the image bearing component and belt, and in which a toner image is transferred onto the belt, or the transfer medium on the belt.

Transfer units such as those described above suffer from "belt deviation", which is a phenomenon that as the belt is circularly moved, it laterally shifts in the belt width direction (which is parallel to axle of belt-suspending-tensioning roller) which is roughly perpendicular to the direction of the belt movement. There have been proposed various structural arrangements for controlling the belt deviation. One such arrangement is disclosed in Japanese Laid-open Patent Application No. H11-116089. According to this application, as the belt laterally shifts, it drives a cam so that one of the belt-suspending-tensioning components is displaced in a manner to be angled relative to the other belt-suspending-tensioning components, to control the belt deviation.

However, a structural arrangement such as the one disclosed in Japanese Laid-open Patent Application No. H11-116089 suffers from a problem that as the belt-suspending-tensioning component is tilted, the transfer section which is adjacent to the belt-suspending-tensioning component which is to be tilted changes in width (nip width).

More specifically, referring to part (a) of FIG. 13, before the belt deviation occurs, the width of the transfer nip which is the area of contact between a photosensitive drum 1*d*, as an image bearing component, which is in the form of a drum, and a belt 5, is N1. In comparison, referring to part (b) of FIG. 13, as the belt deviation occurred, and therefore, the belt-suspending-tensioning component is tilted to move the front side (in drawing) upward to move the belt back to its normal position, the width of the transfer nip which is the area of contact between the photosensitive drum 1*d* and belt 5 changes from N1 to N2 (N2>N1), on the front side in the drawing, in terms of the lengthwise direction of the photosensitive drum 1. Consequently, the transfer nip changes in performance (transfer performance), which sometimes results in the occurrence of image defects.

In order to prevent the transfer nip from changing in width (minimize amount by which transfer nip changes in width), it is necessary to reduce the amount (angle) by which the belt-suspending-tensioning component 7 is tilted. However, reducing the belt-suspending-tensioning component 7 in the amount by which it is tilted sometimes makes it impossible to fully control the belt deviation as the belt deviation occurs. More concretely, it sometimes reduces the speed and/or amount, with which the belt deviation is controlled. Thus, from the standpoint of reliably controlling the belt deviation while preventing the occurrence of image defect, it has become necessary to find new technologies for controlling the belt deviation.

Thus, the primary object of the present invention is to provide a combination of a transfer unit and an image forming apparatus, which can more reliably control the belt deviation while preventing the transferring section from changing in nip width to prevent the occurrence of image defects, than any conventional combination of a transfer unit and an image forming apparatus.

SUMMARY OF THE INVENTION

According to an aspect of the present invention, there is provided an image forming apparatus comprising an image bearing member configured to carry a toner image; a transfer unit configured to transfer the toner image from said image bearing member onto a transfer material, said transfer unit including a movable endless belt, a first stretching roller configured to stretch said belt, a second stretching roller configured to stretch said belt, and an adjusting unit configured to adjust movement of said belt in a widthwise direction of said belt by inclining said first stretching roller relative to said second stretching roller; wherein said transfer unit further including a contacting member provided between said first stretching roller and said image bearing member in a moving direction of said belt and contacting with an inner surface of said belt, and said contacting member is supported such that said contacting member contacts the inner surface of said belt at a position in an image bearing member side across a common internal tangent between a surface of said image bearing member and such a portion of a surface of said first stretching roller as is moved closest to said image bearing member by said adjusting unit, the common internal tangent contacting a portion of said image bearing member adjacent to a position where said image bearing member contacts said belt and contacting a portion of said first stretching roller adjacent to a position where said first stretching roller contacts said belt.

Further features of the present invention will become apparent from the following description of exemplary embodiments (with reference to the attached drawings).

Figure 2:
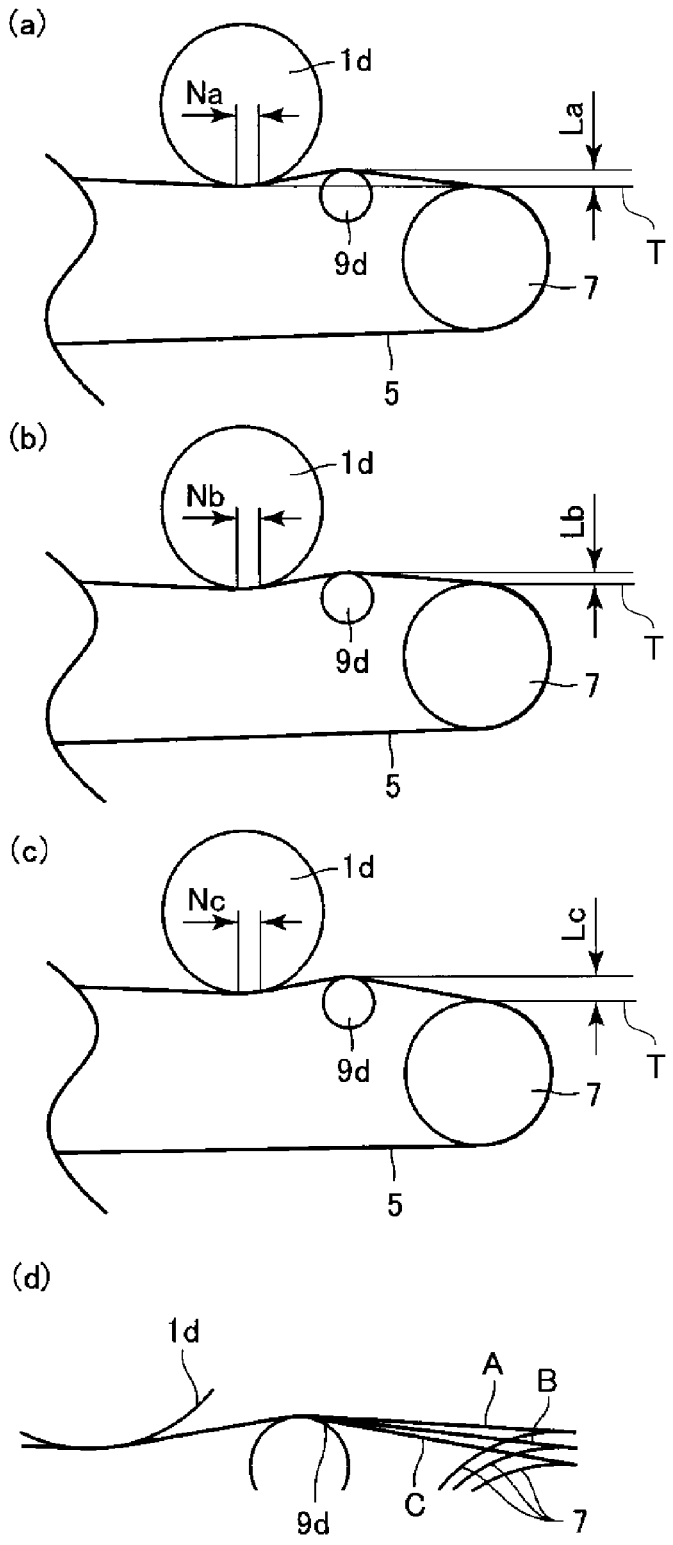

Parts (a), (b), (c) and (d) of FIG. 2 are schematic views of the primary transfer nip in the first embodiment of the present invention, while the transfer unit is controlled in belt deviation.

Figure 3:
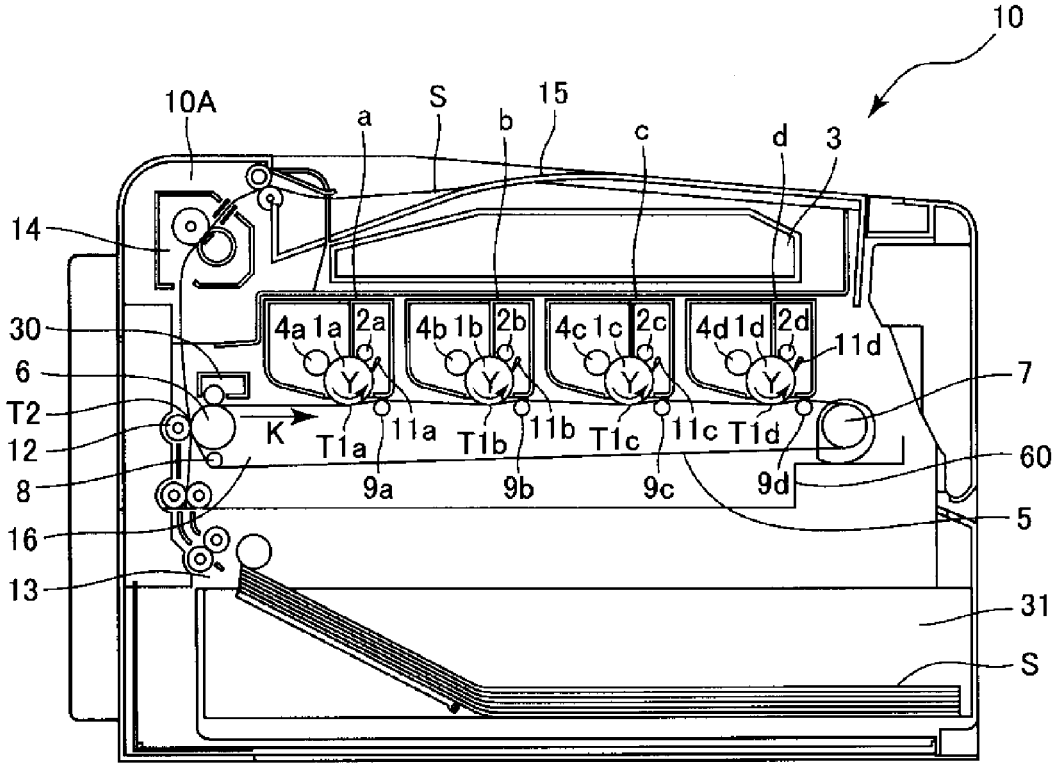

FIG. 3 is a sectional view of the image forming apparatus in the first embodiment.

Figure 4:
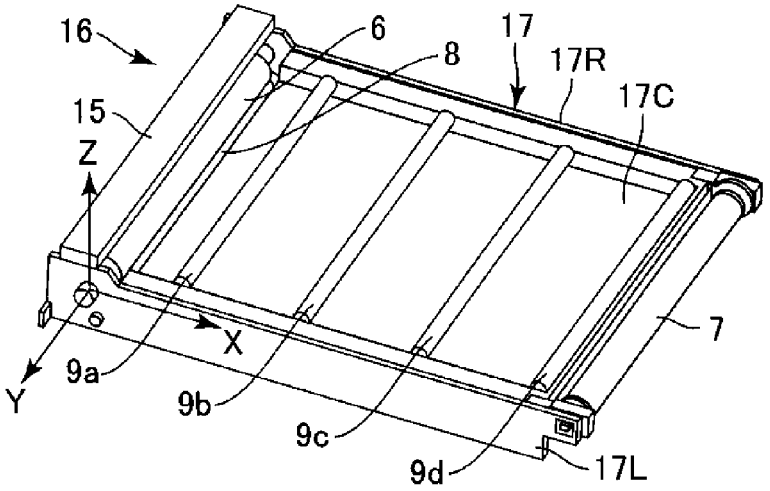

FIG. 4 is a perspective view of the transfer unit in the first embodiment.

Figure 5:
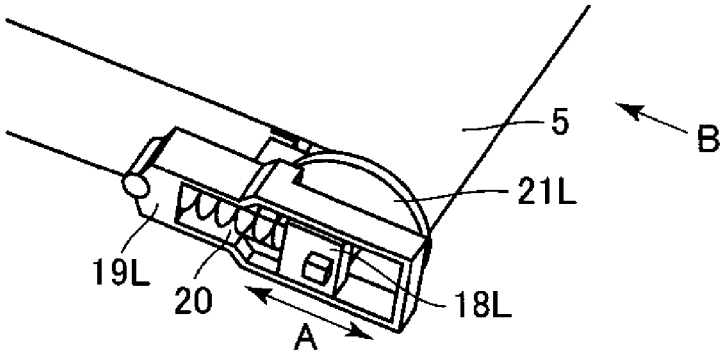

FIG. 5 is a perspective view of the mechanism for providing the intermediary transfer belt with tension, in the first embodiment.

Figure 6:
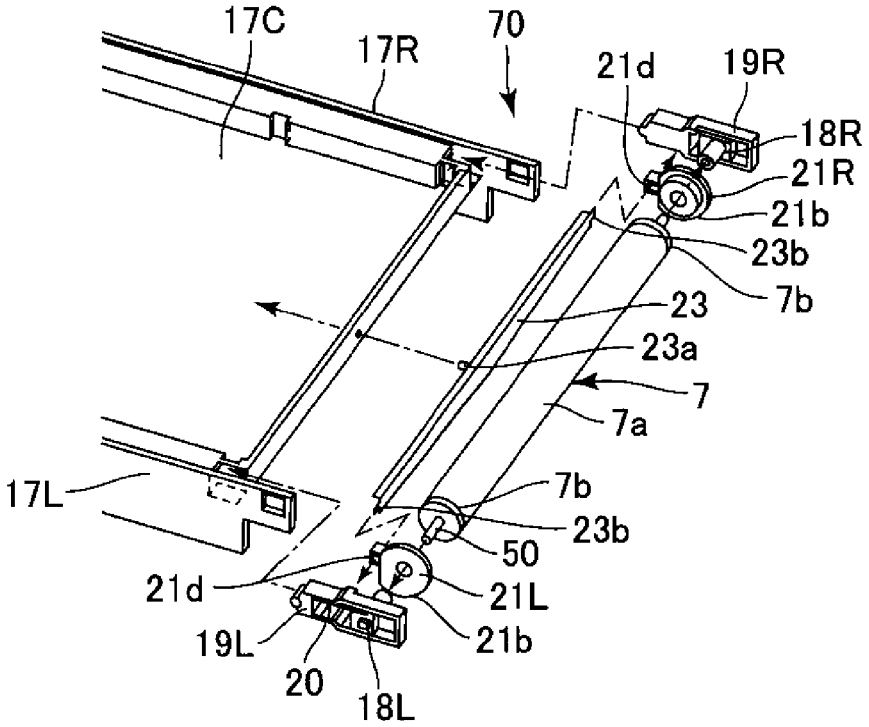

FIG. 6 is an exploded perspective view of the belt deviation control mechanism in the first embodiment.

Figure 7:
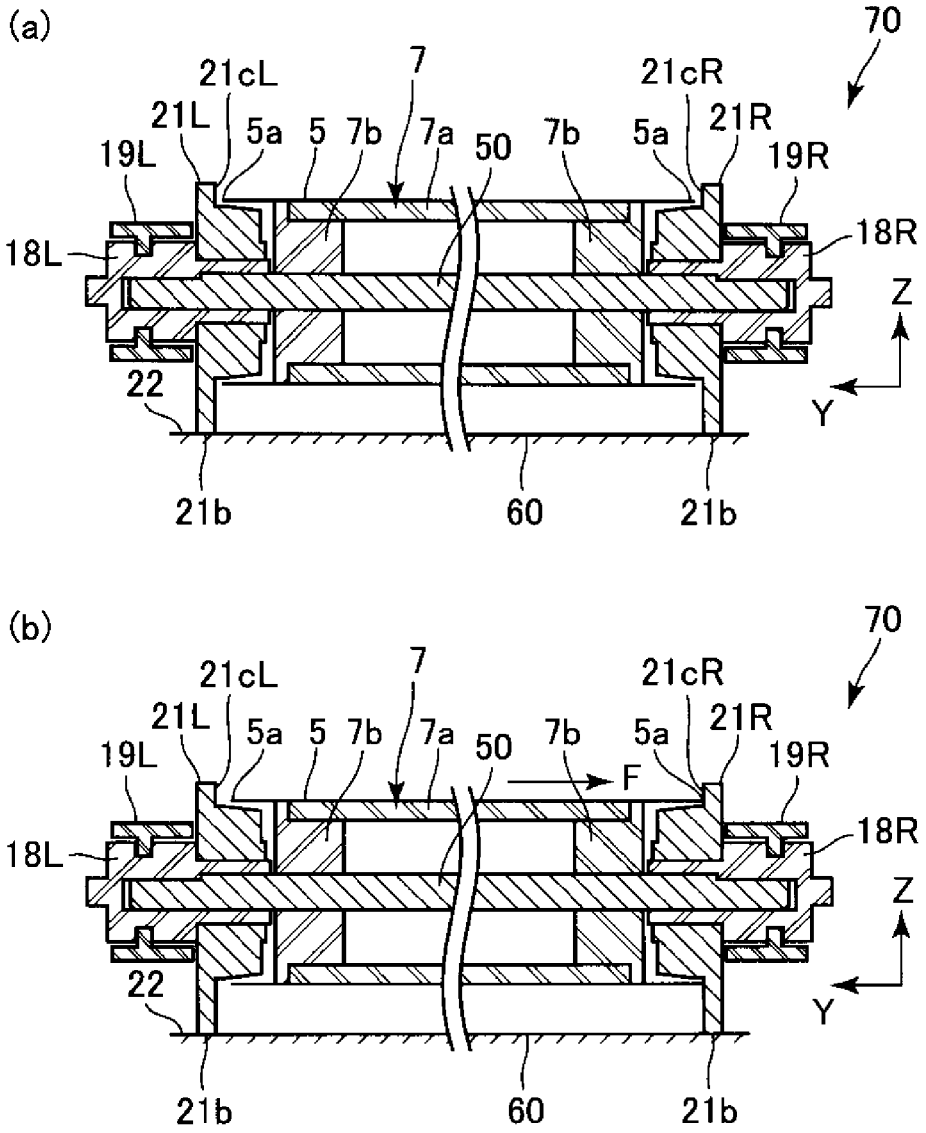

Parts (a) and (b) of FIG. 7 are sectional views of the belt deviation control mechanism in the first embodiment, as seen from the direction indicated by an arrow mark B in FIG. 5.

Figure 8:
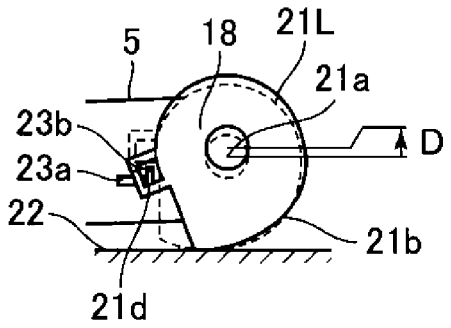
Figure 8:
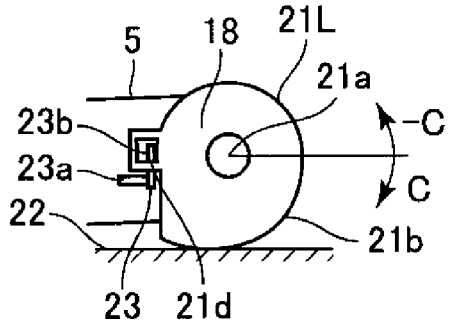
Figure 8:
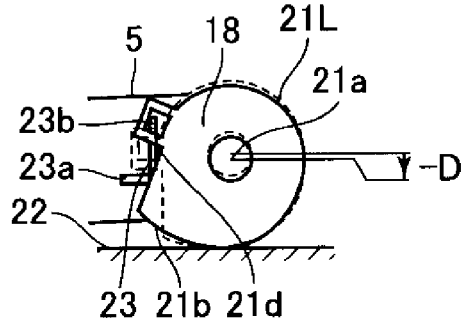

Parts (a), (b) and (c) of FIG. 8 are schematic views illustrating the movement of the controlling component of the belt deviation control mechanism in the first embodiment.

Figure 9:
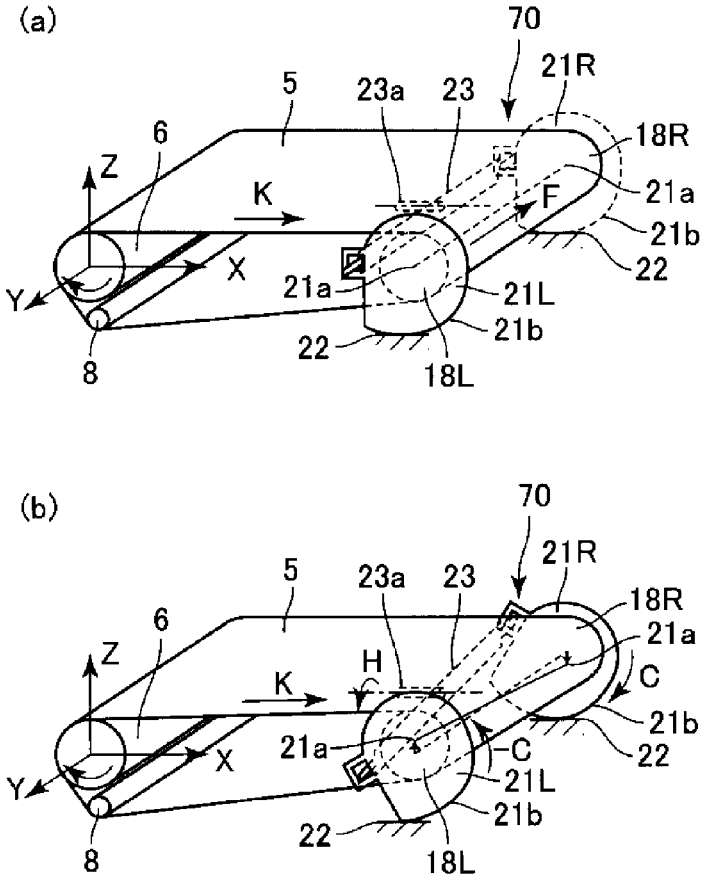

Parts (a) and (b) of FIG. 9 are schematic views illustrating the operation of the belt deviation control mechanism in the first embodiment.

Figure 10:
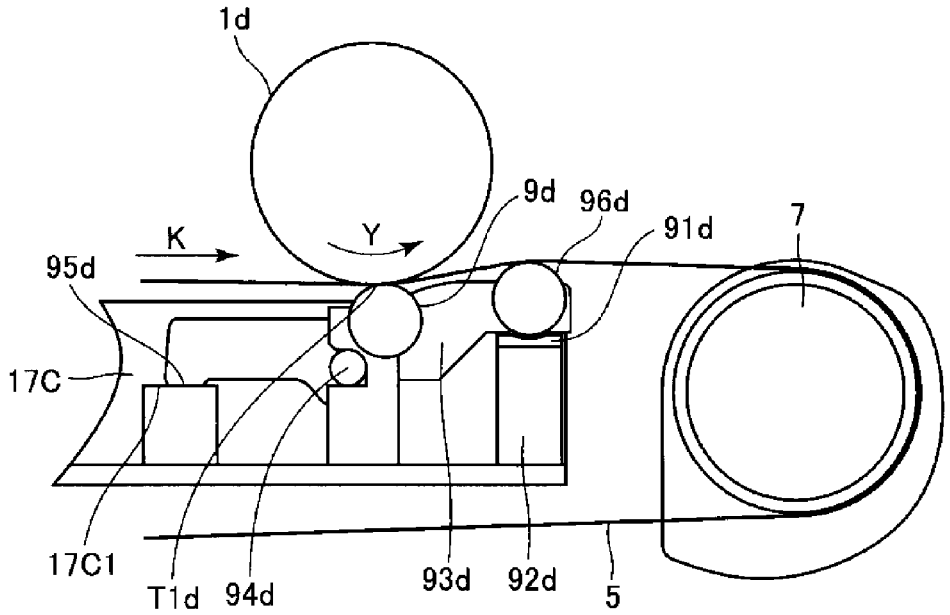

FIG. 10 is a sectional view of the primary transfer nip and its adjacencies in another (second) embodiment of the present invention.

Figure 11:
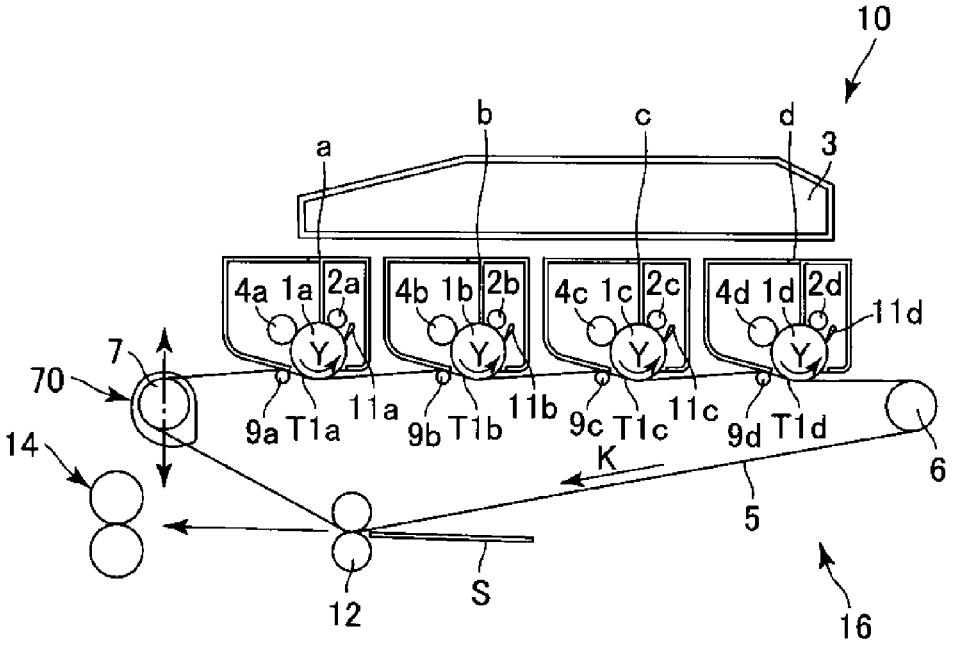

FIG. 11 is a sectional view of the portions of the image forming apparatus in the second embodiment, which are essential for describing the second embodiment.

Figure 12:
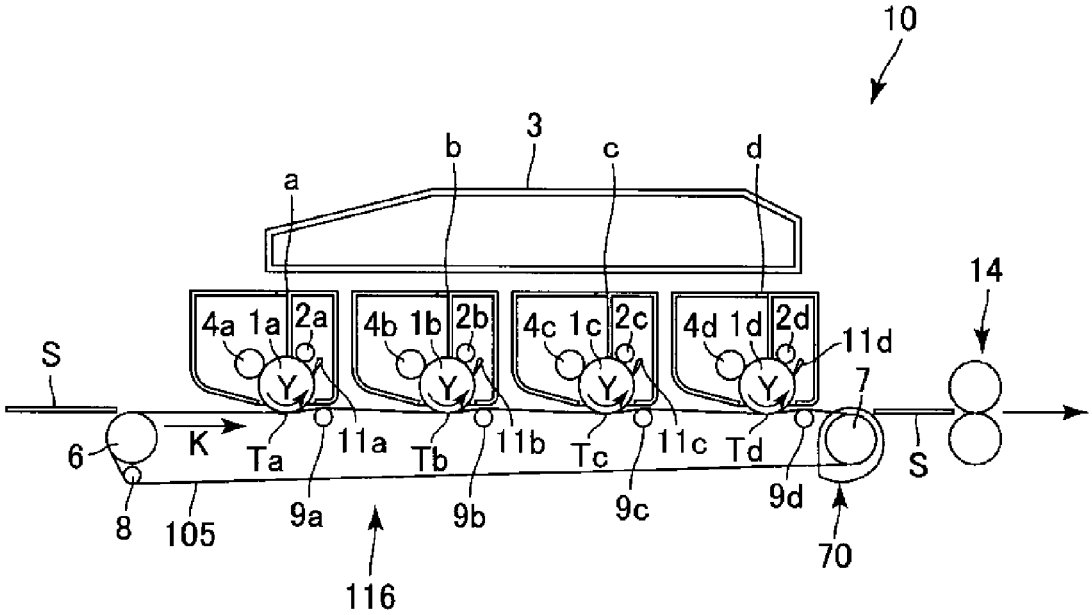

FIG. 12 is a sectional view of the portions of the image forming apparatus, in another (third) embodiment of the present invention, which are essential for describing the third embodiment.

Figure 13:
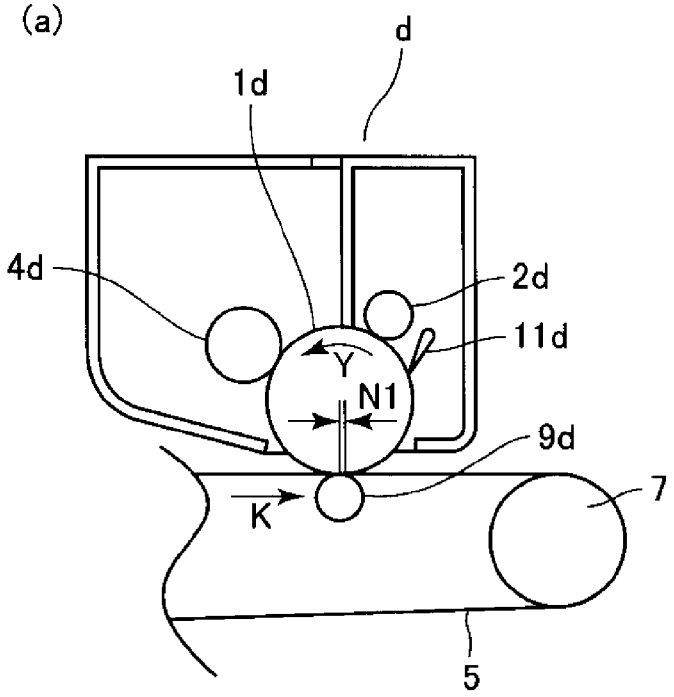
Prior Art Fig. 13
Figure 13:
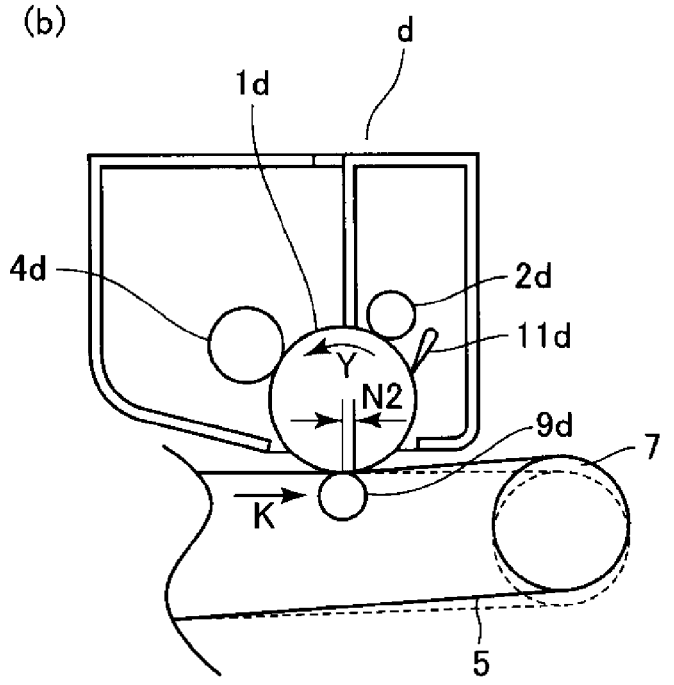
Prior Art Fig. 13

Parts (a) and (b) of FIG. 13 are sectional views of the essential portions of a comparative image forming apparatus, illustrating structure of the comparative image forming apparatus.

DESCRIPTION OF THE EMBODIMENTS

Hereinafter, the transfer unit and image forming apparatus, which are in accordance with the present invention, are described in detail with reference to appended drawings. The measurements, materials, and shapes of the structural components of the image forming apparatus in the following embodiments of the present invention, and the positional relationship among the structural components, etc., are to be modified as necessary based on the structure of an apparatus to which the present invention is applied and various conditions under which an apparatus is used. That is, they are not intended to limit the present invention in scope, unless specifically noted.

Embodiment 1

1. Overall Structure and Operation of Image Forming Apparatus

FIG. 3 is a schematic sectional view of the image forming apparatus in the first embodiment of the present invention. The image forming apparatus 10 in this embodiment is a color image forming apparatus of the so-called tandem type, and also, of the intermediary transfer type. It is capable of forming full-color images with the use of an electrophotographic image forming method. This image forming apparatus 10 has a transfer unit having a belt deviation controlling mechanism which is in accordance with the present invention.

The image forming apparatus 10 forms an image on a sheet S of transfer medium such as recording paper, OHP film, etc., with the use of an electrophotographic image forming method, based on signals sent from a personal computer or the like external device which is in connection with the image forming apparatus 10 in such a manner that communication is possible between the external device and image forming apparatus 10. There are multiple image formation units, more specifically, the first, second, third, and fourth image formation units a, b, c and d, which form yellow, magenta, cyan and black monochromatic toner images, respectively, in the image forming apparatus 10. In this embodiment, the multiple image formation units are aligned roughly in the horizontal direction. There is also an intermediary transfer belt unit 16 (intermediary transfer unit) in the image forming apparatus 10, being disposed so that it opposes all of the image formation units a, b, c and d. The intermediary transfer unit 16 is an integration of the intermediary transfer belt 5 and the other components related to intermediary transfer. More concretely, it has the intermediary transfer belt 5, as an intermediary transferring component, which is an endless belt, and multiple belt-supporting-tensioning components, that is, a driver roller 6, a tension roller 7, and an idler roller 8, by which the endless belt is supported and kept tensioned. The intermediary transfer belt 5 is disposed in such an attitude that it can be circularly moved while opposing each of the image formation units a, b, c and d. The first, second, third and fourth image formation units a, b, c and d are aligned in the listed order in the direction parallel to the moving direction of the intermediary transfer belt 5, that is, in the direction parallel to the portion of the surface of the intermediary transfer belt 5, which faces the first, second, third, and fourth image formation units a, b, c and d.

The image formation units a, b, c and d are practically the same in structure and operation, although they are different in the color of the toner image they form. Therefore, the fourth image formation unit d is described as an exemplary unit.

In the image formation unit d, a toner image is formed by one of the known electrophotographic image formation processes. The image formation unit d is provided with the photosensitive drum 1*d*, as an image bearing component, which is in the form of a drum (cylindrical), and which is circularly movable in the direction indicated by an arrow mark Y in the drawing. The image formation unit d is provided also with a charge roller 2*d*, as a charging means, which is a charging component in the form of a roller. In a typical image forming operation, the peripheral surface of the photosensitive drum 1*d* is uniformly charged by the charge roller 2*d* to a preset polarity (negative in this embodiment) and a preset potential level. Then, the uniformly charged portion of the peripheral surface of the photosensitive drum 1*d* is scanned by (exposed to) a beam of light generated by a laser scanner, as an exposing means, in accordance with the signals sent from a computer. Consequently, an electrostatic latent image (electrostatic image) is effected on the peripheral surface of the photosensitive drum 1*d*.

The electrostatic latent image on the photosensitive drum 1*d* is developed by the developing device 4*d* into a toner image, which is a visible image formed of toner. More concretely, the developing device 4*d* is provided with a development roller disposed in a manner to oppose the photosensitive drum 1*d*. The development roller conveys toner from a developer storage section in which toner is stored, to the photosensitive drum 1*d* to develop the electrostatic latent image on the photosensitive drum 1*d*. In this embodiment, the electrostatic latent image formed in the exposing section is reversely developed. That is, as the peripheral surface of the photosensitive drum 1*d* is uniformly charged, and exposed, the exposed points of the peripheral surface of the photosensitive drum 1*d* reduce in potential level (in terms of absolute value). In this embodiment, it is these points which reduced in potential level that toner, which is the same in polarity as the charge given to the peripheral surface of the photosensitive drum 1*d*, adheres.

The toner image formed on the peripheral surface of the photosensitive drum 1*d* is electrostatically transferred (primary transfer) onto the intermediary transfer belt 5 by the function of the primary transfer roller 9*d*, while the intermediary transfer belt 5 is circularly moved in the direction indicated by an arrow mark K in the drawing, in the primary transfer nip T1*d* (primary transferring section). The primary transfer nip T1*d* is the area of contact between the photosensitive drum 1*d* and intermediary transfer belt 5. During the primary transfer, the primary transfer voltage (primary transfer bias) which is DC voltage (positive in this embodiment) which is opposite in polarity from the charge which toner has during development, is applied to the primary transfer roller 9*d*. Thus, a transfer electric field is formed in the primary transfer nip T1*d*.

In this embodiment, the image forming apparatus 10 is provided with four primary transfer rollers 9*a*-9*d*, each of which is a primary transferring component in the form of a roller. The primary transfer rollers 9*a*-9*d* are disposed on the inward side of the loop (belt loop) which the intermediary transfer belt 5 forms. In terms of the moving direction of the intermediary transfer belt 5, the primary transfer rollers 9*a*-9*d* are disposed on the downstream side of the photosensitive drums 1*a*-1*d*, respectively. They form the primary transfer nips T1*a*-T1*d* by lifting upward the portions of the intermediary transfer belt 5, which are between the photosensitive drums 1*a*-1*d*, and the primary transfer roller 9*a*-9*d*, respectively. The structure of the transfer unit 16, the structure of the primary transfer nip T1*a*-T1*d*, etc., are described later in details.

The primary transfer residual toner, that is, the toner remaining on the peripheral surface of the photosensitive drum 1*d* after the primary transfer, is removed from the peripheral surface of the photosensitive drum 1*d*, and is recovered, by a drum cleaning device 11*d* as a means for cleaning the photosensitive drum 1*d*; the photosensitive drum 1*d* is cleaned by the drum cleaning device 11*d*. Thereafter, the photosensitive drum 1*d* is used again for the image formation process which begins with the charging of the photosensitive drum 1*d*.

In a color image forming operation, four monochromatic toner images, different in color, are formed on the photosensitive drums 1*a*, 1*b*, 1*c* and 1*d*, one for one, in synchronism with the movement of the intermediary transfer belt 5, and are sequentially transferred in layers onto the intermediary transfer belt 5. Consequently, a full-color image is effected on the intermediary transfer belt 5 by the layered monochromatic toner images.

Meanwhile, a sheet S of transfer medium is sent out from a transfer medium storing section 31 by a feeding-conveying means 13 or the like, and is conveyed to the secondary transfer nip T2 (secondary transferring section) with the same timing as the toner images on the intermediary transfer belt 5. The secondary transfer nip T2 is the area of contact between the secondary transfer roller 12, as the secondary transferring means, which is a secondary transferring component in the form of a roller, and the intermediary transfer belt 5. The secondary transfer roller 12 is kept pressed toward the driver roller 6 (which doubles as belt-backing roller), with the presence of the intermediary transfer belt 5 between itself and driver roller 6. The toner images on the intermediary transfer belt 5 are electrostatically transferred (secondary transfer) onto a sheet S of transfer medium by the function of the secondary transfer roller 12, in the secondary transferring section T2. During the secondary transfer, the secondary transfer voltage (secondary transfer bias) which is DC voltage and is opposite in polarity from the toner charge (normal polarity) during development is applied to the secondary transfer roller 12. Thus, transfer electric field is formed in the secondary transfer nip T2.

Then, the sheet S of transfer medium is separated from the intermediary transfer belt 5, and is conveyed to a fixation unit 14, in which the toner images on the sheet S are pressed and heated, becoming thereby firmly fixed to the sheet S. Thereafter, the sheet S is further conveyed, and is discharged onto a delivery tray 15. The secondary transfer residual toner, which is the toner remaining on the surface of the intermediary transfer belt 5 after the secondary transfer, is removed from the surface of the intermediary transfer belt 5, and is recovered, by a belt cleaning device 30 as an intermediary transferring component medium cleaning means; the intermediary transfer belt 5 is cleaned by the belt cleaning device 30.

In this embodiment, the transfer unit 16 is removably installable in the main assembly 10A of the image forming apparatus 10. Further, the photosensitive drums 1*a*-1*d* of the image formation units a-d, respectively, and the processing means which process the photosensitive drums 1*a*, 1*b*, 1*c* and 1*d*, and the frame by which the photosensitive drums 1 and process means are supported, may be integrated in the form of a cartridge (process cartridge), which is removably installable in the apparatus main assembly 10A. By the way, the processing means may be only one among the charge roller 2 (2*a*-2*d*), developing device 4 (4*a*-4*d*), and photosensitive component cleaning device 11 (11*a*-11*d*).

2. Intermediary Transfer Belt Unit

Next, the overall structure of the transfer unit 16, the structure of the mechanism which provides the intermediary transfer belt 5 with tension, and the structure of the belt deviation control mechanism are described.

Figure 1:
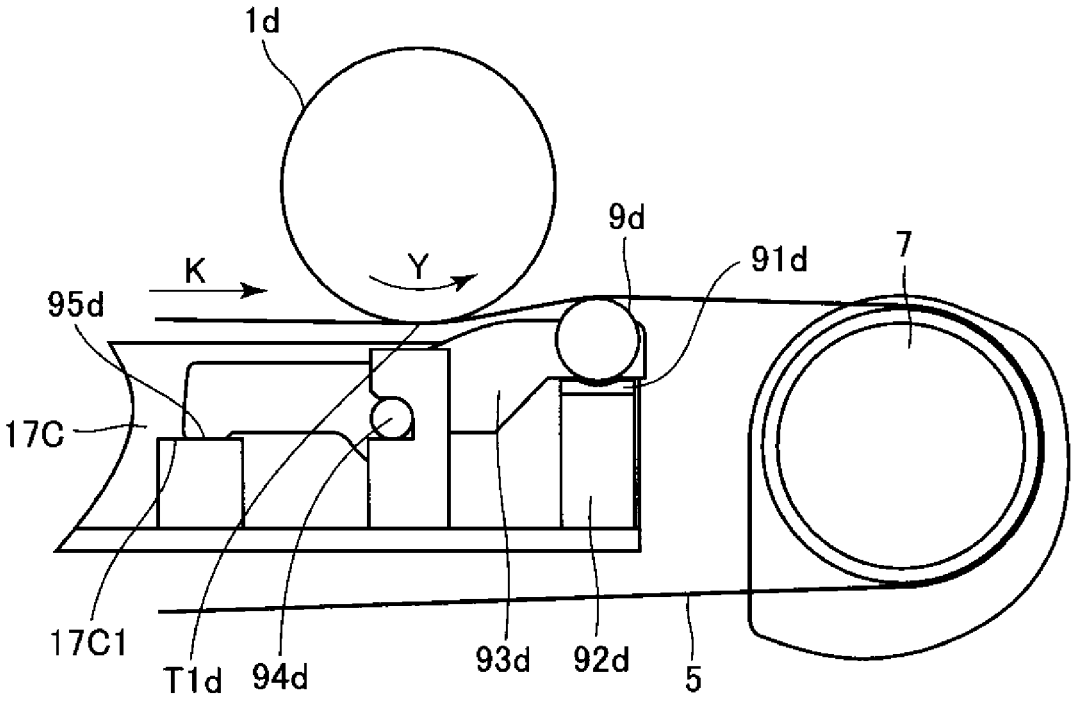
FIG. 1 is a sectional view of the primary transfer nip and its adjacencies, in one (first) of the preferred embodiments of the present invention.

To begin with, the overall structure of the transfer unit 16 is described with reference to FIG. 4, which is a perspective view of the transfer unit 16 in this embodiment. By the way, regarding the orientation of the image forming apparatus 10 and its elements, the front and rear sides of the sheet of paper on which FIG. 1 is drawn are referred to as the "left and right sides", respectively, and the right and left sides of the sheet of paper on which FIG. 1 is drawn are referred to as "front and rear sides", respectively. A straight line which is perpendicular to the above-described "left and right sides" is roughly parallel to the rotational axis of each of the photosensitive drums 1*a*, 1*b*, 1*c* and 1*d*, and also, to the rotational axis of the driver roller 6 for the intermediary transfer belt 5. Further, a straight line which is perpendicular to the above-described "front and rear sides" is referred to an axis X, and a straight line which is perpendicular to the "left and right sides", and which is perpendicular to the axis X is referred to as an axis Y. Moreover, a straight line which is perpendicular to both the axes X and Y is referred to as an axis Z.

The transfer unit 16 has the intermediary transfer belt 5. Further, the transfer unit 16 has multiple belt-suspending-tensioning rollers, more specifically, the driver roller 6, tension roller 7, and idler roller 8. Further, the transfer unit 16 has: a pair of sub-frames 17L and 17R (referential letters L and R stands for left and right sides, respectively) which support the multiple belt-suspending-tensioning rollers. Further, the transfer unit 16 has a central sub-frame 17C which is disposed in a manner to bridge between the left and right sub-frames 17L and 17R. A combination of the left and right sub-frames 17L and 17R, and central sub-frame 17C makes up the transfer unit frame 17. Moreover, the transfer unit 16 has primary transfer rollers 9*a*, 9*b*, 9*c* and 9*d*, as belt contacting components, which contact the inward surface of the intermediary transfer belt 5 in terms of the loop (belt loop) which the intermediary transfer belt 5 forms.

The driver roller 6 and idler roller 8 are positioned relative to the left and right sub-frames 17L and 17R by a pair of bearings fixed to the left and right sub-frames 17L and 17R. The rotational axis of each of the driver roller 6 and idler roller 8 is rotatably supported by a pair of bearings. As for the tension roller 7, it is supported by the left and right sub-frames 17L and 17R in such a manner that it can be moved relative to the left and right sub-frames 17L and 17R by controlling components 21L and 21R (FIG. 6), which will be described later. The driver roller 6 is rotationally driven by an unshown driving means, and circularly moves the intermediary transfer belt 5. The tension roller 7 and idler roller 8 remain in contact with the intermediary transfer belt 5, and are rotated by the circular movement of the intermediary transfer belt 5. The direction of the rotational axis of the driver roller 6 and the direction of the rotational axis of the idler roller 8 are roughly parallel to the direction of the rotational axis of the photosensitive drum 1*d*. The tension roller 7 can be tilted so that the direction of its rotational axis tilts relative to the direction of the rotational axis of the driver roller 6. Further, in terms of the direction which is parallel to the direction of the rotational axis of each of the driver roller 6, idler roller 8 and tension roller 7, the length of each of the driver roller 6, idler roller 8, and tension roller 7 is roughly the same as the width of the intermediary transfer belt 5. The transfer unit 16 and image forming apparatus 10 are structured so that the transfer unit 16 is removably installable into the main assembly 10A of the image forming apparatus 10, and also, that as the transfer unit 16 is installed into the apparatus main assembly 10A, it is fixed in position relative to a frame 60 of the apparatus main assembly 10A by an automatic clamp or the like component.

Next, referring to FIGS. 5 and 6, the mechanism which provides the intermediary transfer belt 11 with tension is described regarding its structure. FIG. 5 is a perspective view of the left end portion, in terms of the direction parallel to the rotational axis of the tension roller 7, of the tension roller 7 which provides the intermediary transfer belt 5 with tension, and its adjacencies. FIG. 6 is an exploded perspective view of the tension roller 7 and its adjacencies. It is for describing the tension roller 7, and the structural components which are in the adjacencies of the tension roller 7.

Referring to FIGS. 5 and 6, a pair of tension roller bearings 18L and 18R are in engagement with a pair of tension roller bearing holders 19L and 19R, respectively, in such a manner that, the tension rollers bearings 18L and 18R are movable in the direction indicted by an arrow mark A in FIG. 5. The tension roller bearings 18L and 18R are kept pressed in the inward-to-outward direction of the belt loop by a pair of tension springs 20, as a pressure applying means, which are placed between the tension rollers bearings 18L and 18R and the tension roller bearing holders 19L and 19R, respectively, in the direction indicated by an arrow mark A in FIG. 5. Thus, the tension roller bearings 18L and 18R press the tension roller 7 in the direction to provide the intermediary transfer belt 5 with tension. Referring to FIG. 6, the tension roller 7 has a tension roller sleeve 7*a*, a tension roller flange 7*b*, and a tension roller shaft 50, which rotate together. The lengthwise ends of the tension roller shaft 50 are rotatably supported by the tension roller bearings 18L and 18R, one for one, which are the tension roller supporting components.

Next, referring to FIGS. 5-8, a deviation control unit 70 is described. The deviation control unit 70 is a controlling means which functions as the intermediary transfer belt 5 shifts in the belt width direction, which is roughly perpendicular to the moving direction of the intermediary transfer belt 5.

The deviation control unit 70 in this embodiment comprises: the tension roller 7, that is, one of the belt-suspending-tensioning components, which doubles as a tiltable roller (steering roller), and the first and second controlling components 21L and 21R. The tension roller 7 is the first belt-suspending-tensioning roller. The deviation control unit 70 controls (regulates) the belt deviation by tilting the first belt-suspending-tensioning roller relative to the second belt-suspending-tensioning roller, which is the driver roller 6.

The controlling components 21L and 21R come into contact with the intermediary transfer belt 5 as the intermediary transfer belt 5 shifts frontward and rearward, respectively. The deviation control unit 70 is structured so that the controlling components 21L and 21R are rotatable by the force which they receive from the intermediary transfer belt 5. Referring to FIG. 6, the controlling components 21L and 21R are attached to the lengthwise ends of the shaft of the tension roller 7, one for one. The controlling components 21L and 21R which function as cams are practically the same in profile, having peripheral surfaces 21*b* (controlling surfaces). As the intermediary transfer belt 5 shifts in the direction parallel to the belt width direction, it comes into contact with one of the controlling components 21L and 21R, and causes the controlling component 21L or 21R to rotate in the same direction as the moving direction of the intermediary transfer belt 5.

Referring to FIG. 7, the peripheral surface 21*b* of each of the controlling components 21L and 21R comes into contact with a corresponding surface of the apparatus main assembly 10A. Further, the controlling components 21L and 21R are rotatably supported by the tension roller bearings 18L and 18R, respectively. Therefore, the rotational axis of each of the controlling components 21L and 21R coincides with the rotational axis of the tension roller 7. Unless the intermediary transfer belt 5 laterally shifts, the left and right controlling components 21L and 21R remain practically symmetrically positioned with respect to the practical center line of the intermediary transfer belt 5 in terms of the belt width direction.

In this embodiment, the deviation control unit 70 is structured so that the surfaces 22, with which the controlling components 21L and 21R remain in contact are the flat surfaces (FIG. 7) of the components disposed below the tension roller 7 in a manner to oppose the controlling components 21L and 21R. The surfaces 22 may be formed as parts of the main assembly frame 60, or parts of the transfer unit 16.

FIG. 8 is a schematic side view of the left controlling component 21L and tension roller 7. It is for showing the relationship between the movement of the left controlling component 21L and the movement of the tension roller 7. As described above, the surface 21*b* (controlling surface), which is a part of the controlling component 21L, is in contact with the surface 22 which is stationary. In this embodiment, the profile of the surface 21*b* of the controlling component 21L is such that as the controlling component 21L is rotated, the tension roller bearing 18L is continuously changed in position in terms of the vertical direction. More concretely, as the controlling component 21L is rotated in the same direction as the moving direction (indicated by arrow mark C) of the intermediary transfer belt 5 when the controlling component 21L is in the state shown in part (b) of FIG. 8, it moves the tension roller bearing 18 downward (state as shown in part (c) of FIG. 8), whereas as the controlling component 21L is rotated in the opposite direction from the moving direction (indicated by arrow mark—C) of the intermediary transfer belt 5 when the controlling component 21L is in the state shown in part (b) of FIG. 8, it moves the tension roller bearing 18 upward (state as shown in part (a) of FIG. 8).

As the intermediary transfer belt 5 shifts in its widthwise direction, and one of the controlling components 21L and 21R is moved (rotated) by the force it receives from the intermediary transfer belt 5, the other controlling component is moved (rotated) in the opposite direction. Referring to FIG. 6, in this embodiment, the controlling components 21L and 21R are connected to each other by a linkage 23, as a connecting component, which is provided as a means for causing the movement of either of the controlling components 21L and 21R to move the other. The linkage 23 is provided with a shaft 23*a* (pivot), which is positioned roughly at the center of the linkage 23 in terms of the width direction of the intermediary transfer belt 5, and is pivotally supported by the central sub-frame 17C. Further, the linkage 23 is provided with a pair of engaging sections 23*b*, which make up the lengthwise ends of the linkage 23, one for one. The engaging sections 23*b* are in engagement with a pair of engaging sections 21*d*, with which the controlling components 21L and 21R are provided, one for one. The engaging sections 21*d* of the controlling components 21L and 21R are on the rear side (left side in FIG. 3) relative to the rotational axis 50 of the tension roller 7 (rear side of apparatus main assembly 10A). In this embodiment, the deviation control unit 70 is structured so that as one of the controlling components 21L and 21R is rotated in one direction (for example, direction indicated by arrow mark C), the other is made to rotate in the opposite direction (for example, direction indicated by arrow mark—C) by the linkage 23.

3. Operation of Belt Deviation Control Mechanism

Next, referring to FIGS. 7-9, the operation of the deviation control unit 70 is described. FIG. 9 is a schematic drawing for describing the operation of the deviation control unit 70.

Referring to part (a) of FIG. 9, it is assumed here that the intermediary transfer belt 5 is being circularly moved by the driver roller 6 in the direction indicated by an arrow mark K in the drawing. If the intermediary transfer belt 5 shifts in the direction (rightward) indicated by an arrow mark F as shown in part (a) of FIGS. 9 and 7(*b*), the right edge 5*a* of the intermediary transfer belt 5 comes into contact with the surface 21*c*R of the right controlling component 21R. (If the intermediary transfer belt 5 shifts in the opposite (leftward) direction, the left edge 5*a* of the intermediary transfer belt 5 comes into contact with the surface 21*c*L of the left controlling component 21L.) Thus, the belt deviation in the direction indicated by the arrow mark F is regulated. As the rightward shifting of the intermediary transfer belt 5 is regulated as described above, contact pressure is generated between the right edge 5*a* of the intermediary transfer belt 5 and the surface 21*c*R of the right controlling component 21R. Hereafter, this contact pressure will be referred to as "deviatory force".

As the right edge 5*a* of the intermediary transfer belt 5 comes into contact with the surface 21*c*R of the right controlling component 21R, the right controlling component 21R is rotated in the same direction as the moving direction (indicated by arrow mark C) of the intermediary transfer belt 5 by the friction generated between the right edge 5*a* and surface 21*c*R by the deviatory force. Thus, the right end of the tension roller 7, toward which the intermediary transfer belt 5 has shifted, is caused to move in the downward direction of the drawing. At the same time, the right controlling component 21R causes the linkage 23, which is in engagement with the right controlling component 21R, to pivot about the shaft 23*a* (pivot) of the linkage 23, in the direction indicated by an arrow mark H. Moreover, the linkage 23 causes the left controlling component 21L, which is in engagement with the opposite end of the linkage 23, to rotate in the opposite direction (indicated by arrow mark—C) from the moving direction of the intermediary transfer belt 5. As the left controlling component 21L is rotated, the left end of the tension roller 7, that is, the opposite end of the tension roller 7 from the end toward which the intermediary transfer belt 5 shifted, is moved upward in the drawing.

Through the above-described operation of the deviation control unit 70, the rotational axis (indicated by referential code 21*a*) of the tension roller 7 is tilted relative to the rotational axis of the driver roller 6. The lengthwise ends of the tension roller 7 in terms of the direction parallel to the rotational axis of the tension roller 7 are made to displace in the opposite direction by roughly the same amount. That is, the tension roller 7 is tilted in such a manner that its front and rear halves symmetrically tilt with respect to the shaft 23*a* (pivot) of the linkage 23.

The transfer unit 16 tilts the tension roller 7 as described above, in order to move the intermediary transfer belt 5 in the opposite direction from the direction (indicated by arrow mark F) in which the intermediary transfer belt 5 initially shifted. Thus, the intermediary transfer belt 5 is controlled in its positional deviation, and therefore, the deviatory force is reduced. As the intermediary transfer belt 5 is reduced enough in deviatory force, the right edge 5*a* of the intermediary transfer belt 5 loses the force for rotating the right controlling component 21R, and therefore, the right controlling component 21R stops rotating. At the same time as the right controlling component 21R stops rotating, the left controlling component 21L also stops rotating. After the right and left controlling components 21R and 21L stop rotating, they remain in the attitude (phase) in which they stopped rotating.

As described above, the deviation control unit 70 in this embodiment is structured so that as the belt deviation occurs, the right and left controlling components 21R and 21L are moved together, but in opposite directions, to tilt the tension roller 7. That is, in this embodiment, the controlling means 70 causes the tension roller 7 (tiltable roller) to tilt in such a manner that the lengthwise ends of the tension roller 7, in terms of the direction parallel to the rotational axis of the tension roller 7, synchronously move in the opposite direction. A deviation control unit, such as those in the preceding embodiments, structured so that its belt-suspending-tensioning component which doubles as its deviation controlling component is tilted by a pair of controlling components attached to the lengthwise ends of the belt-suspending-tensioning roller, one for one, is superior, in terms of the easiness with which the belt-suspending-tensioning roller can be tilted, to a deviation control unit structured so that the belt-suspending-tensioning roller is tilted by a single controlling component attached to one of the lengthwise ends of the belt-suspending-tensioning roller.

4. Primary Transfer Nip

Next, referring to FIGS. 1-3, the primary transfer nip is described in greater detail about its structure.

If a transfer unit 16 is structured so that the belt deviation is controlled by tilting one of its belt-suspending-tensioning components, it sometimes occurs that the transferring section changes in its nip width (dimension of area of contact between image bearing component and belt in terms of belt movement direction). First, referring to part (a) of FIGS. 13 and 13(*b*), a comparative transfer unit structured so that as one of its belt-suspending-tensioning components is tilted, the transferring section changes in nip width is described about its structure.

Referring to part (a) of FIG. 13, it is assumed here that until the belt deviation occurs, the width of the transfer nip which is formed by a combination of the photosensitive drum 1*d*, as an image bearing component, which is in the form of a drum, and the belt 5, is N1, and also, that as the belt deviation occurs, and the belt-suspending-tensioning component 7 is tilted in the direction to cause the front side of the component 7 to move upward to undo the belt deviation. In this case, at the front end (in drawing) in terms of the lengthwise direction of the photosensitive drum 1, the width of the nip between the photosensitive drum 1 and belt 5 changes from N1 to N2 (N2>N1). This change causes the transfer nip to change in performance in terms of toner transfer, resulting sometimes in occurrences of image defects.

In order to control the change in nip width, it is necessary to reduce the amount by which the belt-suspending-tensioning component 7 is tilted. However, reducing the amount by which the belt-suspending-tensioning component 7 is tilted sometimes makes it impossible to successfully control the belt deviation as the belt deviation occurs. More concretely, it sometimes reduces the speed with which the belt deviation is controlled, and/or makes insufficient the amount (extent) by which the belt deviation is controlled. Thus, the belt deviation needs to be more reliably controlled while preventing the occurrence of image defects.

In this embodiment, the tension roller 7 which is tilted by the deviation control unit 70 is in the adjacencies of the photosensitive drum 1*d* of the fourth image formation unit d among the first to fourth image formation units a-d. Thus, the issue here is the change in the width of the primary transfer nip T1 of the fourth image formation unit d. Thus, the structure of the primary transfer nip T1 of the fourth image formation unit d is described in detail.

FIG. 1 is a sectional view of the primary transfer nip T1*d*, and its adjacencies, of the fourth image formation unit d. It shows the structure of the mechanism which supports the primary transfer roller 9*d* by the left end of the roller 9*d*. FIG. 2 is a schematic drawing for showing the positional relationship among the photosensitive drum 1*d*, primary transfer roller 9*d*, tension roller 7, and intermediary transfer belt 5, at the left end of the image forming apparatus 10, during the controlling of the belt deviation.

In this embodiment, the primary transfer roller 9*d* is offset downward relative to the photosensitive drum 1*d* in terms of the moving direction (indicated by arrow mark K) of the intermediary transfer belt 5. As will be described later in detail, from the standpoint of desirably controlling the change which occurs to the nip width of the primary transfer nip T1*d* as the tension roller 7 is tilted, it is desired that the primary transfer roller 9*d* is offset relative to the photosensitive drum 1*d* in such a manner that the primary transfer roller 9*d* is not pressed against the photosensitive drum 1*d* with the presence of the intermediary transfer belt 5 between the primary transfer roller 9*d* and photosensitive drum 1*d*. Here, the amount by which the primary transfer roller 9*d* is offset relative to the photosensitive drum 1*d* is defined as the distance between the rotational axis of the photosensitive drum 1*d* and the rotational axis of the primary transfer roller 9*d* in terms of the direction (roughly horizontal direction) in which the multiple photosensitive drums 1*a*-1*d* are aligned. In this embodiment, it is assumed that as long as the deviation control unit 70 is structured so that the amount of the above-described offset (which hereafter may be referred to as offset amount) is no less than roughly 3 mm, the primary transfer roller 9*d* is not pressed against the photosensitive drum 1*d* with the presence of the intermediary transfer belt 5 between itself and photosensitive drum 1*d*. In this embodiment, the offset amount was set to roughly 8 mm.

The primary transfer roller 9*d* is rotatably supported by a pair of electrically conductive bearings 91*d*; the lengthwise ends of the primary transfer roller 9*d* in terms of the direction parallel to the rotational axis of the primary transfer roller 9*d* are rotatably supported by the bearings 91*d*, one for one. The primary transfer roller 9*d* is pressed upon the inward surface of the intermediary transfer belt 5, in terms of the loop (belt loop) which the intermediary transfer belt 5 forms, by a pair of pressure applying springs 92*d*, as pressure applying means, which are a pair of compression springs, with the presence of the electrically conductive bearings 91*d* between themselves and pressure applying springs 92*d*. Each electrically conducive bearing 91*d* is in connection to a rotational lever 93*d*. The deviation control unit 70 is structured so that the rotational lever 93*d* rotationally moves about a pivot 94*d*. The rotational lever 93*d* is rotationally moved in the counterclockwise direction in the drawing by the electrically conducive bearing 91*d* which is under the pressure from the pressure applying spring 92*d*. Thus, the stopper section 95*d*, which is the opposite end of the rotational lever 93*d* from the electrically conducive bearing 91*d*, comes into contact with the surface 17C1 of the central sub-frame 17C, stopping thereby the rotational movement of the rotational lever 93*d*. As the rotational lever 93*d* is stopped, the primary transfer roller 9*d* becomes fixed in position. By the way, the supporting mechanism on the right side in terms of the direction parallel to the rotational axis of the primary transfer roller 9*d* is the same in structure as the above-described supporting mechanism on the left side (it is symmetrical with right supporting mechanism with respect to practical center of intermediary transfer belt 5 in terms of width direction of intermediary transfer belt 5). The rotational axis of the primary transfer roller 9*d* is roughly parallel to the rotational axis of the photosensitive drum 1*d*. Further, the dimension of the primary transfer roller 9*d* in terms of the direction parallel to its rotational axis is the same as the width of the intermediary transfer belt 5.

Referring to FIG. 1, the primary transfer roller 9*d* which is fixed in position keeps upwardly (in drawing) lifted, the portion of the intermediary transfer belt 5, which is between the photosensitive drum 1*d* and tension roller 7, from the inward side of the belt loop. In this embodiment, the primary transfer roller 9*d* keeps the portion of the intermediary transfer belt 5, which is between the photosensitive drum 1*d* and tension roller 7, lifted by roughly 1 mm, above the common internal tangent line T which is tangential to the peripheral surface of the photosensitive drum 1*d* and the peripheral surface of the tension roller 7 when the tension roller 7 is in its neutral position, which is such a position that when the tension roller 7 is in the position, the rotational axis of the tension roller 7 is not tilted relative to the rotational axis of the driver roller 6. The internal tangent line T is such one of the two mathematical common internal tangent lines between the photosensitive drum 1*d* and the tension roller 7 as contacts a portion of the photosensitive drum 1*d* adjacent to the position where the photosensitive drum 1*d* contacts the belt 5 and contacts a portion of the tension roller 7 adjacent to the position where the tension roller 7 contacts the belt 5. Further, the surface of the photosensitive drum 1*d* and the surface of the tension roller 7, which define the above-described tangential line T, are such a portion of the surface of the photosensitive drum 1*d* and such a portion of the surface of the tension roller 7 that can be contacted by the intermediary transfer belt 5.

As the intermediary transfer belt 5 is lifted as described above, the intermediary transfer belt 5 is bent in a manner of conforming to the curvature of the photosensitive drum 1*d*, substantially increasing in width the primary transfer nip T1*d* formed between the intermediary transfer belt 5 and photosensitive drum 1*d*. Moreover, the primary transfer roller 9*d* causes the portion of the intermediary transfer belt 5, which is between the photosensitive drum 1*d* and tension roller 7, to protrude upward (in drawing) beyond the straight line T which is tangential to the peripheral surface of the photosensitive drum 1*d*, and the peripheral surface of the tension roller 7 even when one of the lengthwise ends of the tension roller 7 is in its highest position. As described above, in this embodiment, the primary transfer roller 9*d* doubles as a component for causing the above-described portion of the intermediary transfer belt 5 to protrude upward as described above. Because the deviation control unit 70 in this embodiment is structured as described above, it is capable of preventing the primary transfer nip T1*d* from changing in nip width when the tension roller 7 is tilted to control the belt deviation, and therefore, is capable of preventing the occurrences of the image defects attributable to the change in the transfer performance of the primary transfer nip T1*d*, as will be described later in detail.

Here, in this embodiment, the primary transfer roller 9*d* was an electrically conductive component, more specifically, a metallic roller. It is placed in contact with the intermediary transfer belt 5, and is rotated by the intermediary transfer belt 5 as the intermediary transfer belt 5 moves. Further, an electric field (transfer electric field) is generated in the primary transfer nip T1*d* by the application of voltage to the primary transfer roller 9*d* from an unshown electric power source, to electrostatically transfer the toner image on the photosensitive drum 1*d* onto the intermediary transfer belt 5.

Next, referring to FIGS. 2 and 9, the movements which occur to various components of the deviation control unit 70 as the belt deviation occurs are described.

Part (a) of FIG. 2 shows the positional relationship among the tension roller 7, intermediary transfer belt 5, etc., at the left end of the deviation control unit 70, prior to the occurrence of the belt deviation. Prior to the occurrence of the belt deviation, the tension roller 7 is not tilted relative to the driver roller 6. That is, the right end of the tension roller 7 is at the same level as the one shown in part (a) of FIG. 2. When the tension roller 7 is in the attitude described above, the primary transfer roller 9*d* keeps the intermediary transfer belt 5 protrusive upward (in drawing) beyond the straight line T which is tangential to the peripheral surface of the photosensitive drum 1*d* and the peripheral surface of the tension roller 7 (La in part (a) of FIG. 2). That is, the primary transfer roller 9*d* keeps the abovementioned portion of the intermediary transfer belt 5 on the photosensitive drum side of the straight line T which is tangential to the peripheral surface of the photosensitive drum 1*d* and the peripheral surface of the tension roller 7 (La in part (a) of FIG. 2), as described above. In this case, the width of the primary transfer nip T1*d* formed between the photosensitive drum 1*d* and intermediary transfer belt 5 is Na.

Part (b) of FIG. 2 shows the positional relationship among the tension roller 7, intermediary transfer belt 5, etc., at the left end of the deviation control unit 70, after the intermediary transfer belt 5 shifted in the direction indicated by the arrow mark K in the drawing (rightward direction), and the tension roller 7 was tilted as much as it can be, that is, the left end of the tension roller 7 is at its highest level. Even in a case where the tension roller 7 is tilted upward as much as possible, the primary transfer roller 9*d* keeps the portion of the intermediary transfer belt 5, which is between the photosensitive drum 1*d* and tension roller 7, above the straight line T which is tangential to the peripheral surface of the photosensitive drum 1*d* and the peripheral surface of the tension roller 7 (Lb in part (b) of FIG. 2). Because the deviation control unit 70 is structured as described above, it is only the angle of contact between the intermediary transfer belt 5 and primary transfer roller 9*d* that changes as the tension roller 7 is tilted (changed in angle). Thus, the portion of the intermediary transfer belt 5, which is on the upstream side of the primary transfer roller 9*d* in terms of the moving direction of the intermediary transfer belt 5, does not change in attitude. Thus, the primary transfer nip T1*d* which is formed by the combination of the photosensitive drum 1*d* and intermediary transfer belt 11 remains unchanged in width (Nb=Na). Further, the angle of the tension roller 7 is largest within the preset range, and is sufficient to control the belt deviation.

By the way, as described above, the deviation control unit 70 is structured so that as the tension roller 7 is tilted, the lengthwise ends of the tension roller 7 are made to displace in the opposite direction, by roughly the same amount. Thus, when the tension roller 7 is in the state shown in part (b) of FIG. 2, the right end of the tension roller 7 is positioned lowest. Also in this case, the positional relationship among the tension roller 7, intermediary transfer belt 5, etc., at the right end of the deviation control unit 70, is roughly the same as their positional relationship at the left end of the deviation control unit 70, when the left end of the tension roller 7 is in the position in which it is when the tension roller 7 is tilted by the largest amount.

In comparison, FIG. 2 (*c*) shows the positional relationship among the tension roller 7, intermediary transfer belt 5, etc., at the left end of the deviation control unit 70, after the intermediary transfer belt 5 shifted in the opposite direction from the direction indicated by the arrow mark F in FIG. 9, and the tension roller 7 was tilted downward (in the drawing) as much as possible relative to the driver roller 6, that is, the left end of the tension roller 7 was positioned lowest. Even after the tension roller 7 was tilted downward (in the drawing) by the maximum amount (angle), the primary transfer roller 9*d* keeps the intermediary transfer belt 5 protrusive above the straight line T which is tangential to both the peripheral surface of the photosensitive drum 1*d* and the peripheral surface of the tension roller 7 (Lc in part (c) of FIG. 2). Because the deviation control unit 70 is structured as described above, it is only the angle of contact between the intermediary transfer belt 5 and primary transfer roller 9*d* that changes as the tension roller 7 is tilted (changed in angle). Thus, the portion of the intermediary transfer belt 5, which is on the upstream side of the primary transfer roller 9*d* in terms of the moving direction of the intermediary transfer belt 5, does not change in attitude. Thus, the primary transfer nip T1*d* which is formed by the combination of the photosensitive drum 1*d* and intermediary transfer belt 11 remains unchanged in width (Nc=Na). Further, the angle of the tension roller 7 is largest within the preset range, and is sufficient to control the belt deviation.

By the way, when the left end of the tension roller 7 is at the lowest position, the right end of the tension roller 7 is at the highest position. Further, the positional relationship among the tension roller 7, intermediary transfer belt 5, etc., at the right end of the deviation control unit 70 is the same as their relationship at the left end of the deviation control unit 70 which occurs as the tension roller 7 is tilted upward as shown in part (b) of FIG. 2.

Part (d) of FIG. 2 is a drawing created by layering part (b) of FIG. 2 which shows the relationship among the tension roller 7, driver roller 6, primary transfer roller 9*d*, and intermediary transfer belt 5 which occurs when the tension roller 7 is parallel to the driver roller 6, and part (a) of FIGS. 2 and 2(*c*) which show the abovementioned relationship which occurs the tension roller 7 is tilted upward and downward, respectively, by the maximum angle. By the way, in this embodiment, the amount (indicated by D (−D) in FIG. 8) by which the left and right ends of the tension roller 7 are moved by the tilting of the tension roller 7 is roughly 1 mm.

As described above, regardless of the angle of the tension roller 7 relative to the driver roller 6, the primary transfer roller 9*d* keeps the portion of the intermediary transfer belt 5, which is between the photosensitive drum 1*d* and tension roller 7, protrusive above, that is, on the photosensitive drum side of, the straight line T which is tangent to the peripheral surface of the photosensitive drum 1*d* and the peripheral surface of the tension roller 7. Thus, it does not occur that the portion of the intermediary transfer belt 5, which is between the photosensitive drum 1*d* and primary transfer roller 9*d*, on the upstream side of the primary transfer roller 9*d* in terms of the moving direction of the intermediary transfer belt 5, is changed in attitude. Therefore, it is possible that the primary transfer nip T1*d* which the combination of the photosensitive drum 1*d* and intermediary transfer belt 5 forms is prevented from changing in nip width; it remains roughly stable in nip width. Thus, the deviation control unit 70 in this embodiment can more reliably control the belt deviation while preventing the occurrence of the image defects attributable to the change in the transfer performance of the transfer nip, than any conventional deviation control unit.

By the way, in this embodiment, from the standpoint of keeping the first to fourth image formation units a-d uniform in transfer performance, etc., the primary transfer nip T1*a*, T1*b*, and T1*c* of the first to third image formation units a-c, respectively, are made the same in structure as the primary transfer nip T1*d* of the fourth image formation unit d. However, from the standpoint of preventing the primary transfer nip from changing in nip width, all that is necessary is to structure only the primary transfer nip T1*d* of the fourth image formation unit d as described above. That is, the primary transfer rollers in other image formation units do not need to be offset. By the way, referring to FIG. 11, in some image forming apparatuses, tiltable belt-suspending-tensioning rollers are placed as deviation controlling components, on the upstream side of the multiple image formation units a-d, one for one. In such a case, the issue is the change which occurs to the nip width of the primary transfer nip T1*a* of the first image formation unit a, the photosensitive drum 1*a* of which is in the adjacencies of the tiltable belt-suspending-tensioning roller which doubles as the deviation control component. Thus, at least the primary transfer nip T1*a* of the first image formation unit a is to be structured like the above-described primary transfer nip T1*d* in this embodiment. More specifically, the primary transfer roller 9*a* is to be offset upstream in terms of the moving direction of the intermediary transfer belt 5, relative to the photosensitive drum 1*a* to keep the portion of the intermediary transfer belt 5 between the primary transfer roller 9*a* (primary transfer roller which doubles as deviation control component) and photosensitive drum 1*a*, protrusive upward (on photosensitive drum side of straight line T which is tangential to both peripheral surface of photosensitive drum and tension roller 7) to form the primary transfer nip T1*a*. In this case, it is not necessary for the primary transfer rollers in the second to fourth image formation units b-d to be offset relative to the photosensitive drums 1*b*, 1*c* and 1*d*, respectively.

As described above, in this embodiment, the transfer unit 16 has multiple belt-suspending-tensioning rollers 6, 7 and 8, and the circularly movable endless belt 5 which is suspended and kept tensioned by the belt-suspending-tensioning rollers 6, 7 and 8. The belt 5 forms the transferring section T1*d* by being placed in contact with the rotatable image bearing component 1*d* which bears a toner image. In the transferring section T1*d*, a toner image is transferred from the image bearing component 1*d*. Further, the transfer unit 16 has the controlling means 70 which controls the shifting of the belt 5 in its widthwise direction. Among the multiple belt-suspending-tensioning rollers, the belt-suspending-tensioning roller 7 which is in the upstream or downstream adjacencies of the transferring sections T1*d* in terms of the moving direction of the belt 5 is a tiltable roller which can be tilted relative to the rotational axis of the other belt-suspending-tensioning roller 6. The controlling means 70 controls the shifting of the belt 5 in its widthwise direction, by tilting the tiltable roller 7 relative to the other belt-suspending-tensioning roller 6. To describe in greater detail, the controlling means 70 is structured to tilt the tiltable roller 7 in such a manner that at least one of the lengthwise ends of the tiltable roller 7 in terms of the direction parallel to the rotational axis of the tiltable roller 7 moves in the direction which is perpendicular to the straight line T which is tangential to the peripheral surface of the tiltable roller 7 and the peripheral surface of the image bearing component 1*d* prior to the tilting of the tiltable roller 7. Further, the transfer unit 16 has a belt pressing component 9*d* which is disposed within the loop which the belt 5 forms, and keeps the portion of the belt 5, which is between the photosensitive drum 1*d* and tiltable roller 7, protrusive outward of the belt loop, (on photosensitive drum side) relative to the straight line T which is tangential to the peripheral surface of the tiltable roller 7 and the peripheral surface of the image bearing component 1*d* even if the tiltable roller 7 is tilted by the maximum angle. In this embodiment, the belt pressing component 9*d* is disposed on the downstream side of the image bearing component 1*d* in terms of the moving direction of the belt 5; it is disposed between the image bearing component 1*d* and the tiltable roller 7 which is in the adjacencies of the primary transferring section T1*d*. However, the belt pressing component 9*d* may be disposed between the tiltable roller 7 which is in the upstream adjacencies of the transferring section in terms of the moving direction of the belt 5, and the image bearing component.

From the standpoint of more desirably controlling the change in the nip width of the transferring section T1*d*, it is desired that the belt pressing component 9*d* is disposed so that the belt pressing component 9*d* is not pressed against the image bearing component 1*d* with the presence of the belt 5 between the belt pressing component 9*d* and image bearing component 1*d*. Further, it is desired that the entire range of the belt pressing component 9*d* in terms of the widthwise direction of the belt 5 remains in contact with the belt 5, regardless of the angle of the tiltable roller 7.

As described above, in this embodiment, the deviation control unit 70 was structured so that the primary transfer roller 9*d* was offset downstream relative to the photosensitive drum 1*d* in terms of the moving direction of the intermediary transfer belt 5, and the intermediary transfer belt 5 was made to protrude to the photosensitive drum side of the straight line T which is tangential to both the photosensitive drum 1*d* and that of the tension roller 7. Further, it is structured so that regardless of the angle of the tiltable roller 7 which is one of the belt-suspending-tensioning rollers and doubles as the deviation controlling component, the primary transfer roller 9*d* can keep the portion of the intermediary transfer belt 5, which is between the photosensitive drum 1*d* and tension roller 7, protrusive to the photosensitive drum side of the straight line T which is tangential to both the peripheral surface of the photosensitive drum 1 and the peripheral surface of the transfer roller 7. Therefore, the deviation control unit 70 can prevent the primary transfer nip T1*d* formed by the combination of the photosensitive drum 1 and intermediary transfer belt 5, from changing in nip width; it can keep the primary transfer nip T1*d* roughly stable in nip width. Therefore, it can more reliably control the belt deviation while preventing the occurrence of the image defects attributable to the change in the transfer performance of the primary transfer nip T1*d*, than any conventional deviation control unit.

Embodiment 2

Next, another (second) embodiment of the present invention is described. The image forming apparatus in this embodiment is the same in basic structure and operation as the image forming apparatus in the first embodiment. Thus, the elements of the image forming apparatus in this embodiment, which are the same as, or equivalent to, the counterparts of the image forming apparatus in the first embodiment, in function or structure, are given the same referential codes as the counterparts, and are not described in detail.

FIG. 10 is a sectional view of the left end, and its adjacencies, of the primary transfer nip T1*d* of the fourth image formation unit d in this embodiment. In this embodiment, the transfer unit 16 is positioned in such a manner that its primary transfer roller 9*d* roughly directly faces the photosensitive drum 1*d*. That is, the primary transfer roller 9*d* is pressed against the photosensitive drum 1*d* with the presence of the intermediary transfer belt 5 between the primary transfer roller 9*d* and photosensitive drum 1*d*.

In this embodiment, a belt pressing roller 96*d* is disposed as a belt pressing component between the primary transfer roller 9*d* and tension roller 7 in terms of the moving direction of the intermediary transfer belt 5. The belt pressing roller 96*d* lifts the portion of the intermediary transfer belt 5, which is between the photosensitive drum 1*d* and tension roller 7, upward (in drawing), that is, outward of the belt loop, from within the belt loop. In this embodiment, the belt pressing roller 96*d* keeps the portion of the intermediary transfer belt 11, which is between the photosensitive drum 1*d* and tension roller 7, protrusive by roughly 1 mm to the photosensitive drum side of toward the photosensitive drum 1*d* relative to the above-described common internal tangent line T which is tangential to both the peripheral surface of the photosensitive drum 1*d* and the peripheral surface of the tension roller 7.

In this embodiment, the primary transfer roller 9*d* and belt pressing roller 96*d* are metallic rollers. They are placed in contact with the intermediary transfer belt 5, and are rotated by the intermediary transfer belt 5 as the intermediary transfer belt 5 moves. In this embodiment, a transfer electric field is generated in the primary transfer nip T1*d* by the application of voltage to the primary transfer roller 9*d* from an unshown electric power source, to electrostatically transfer the toner image from the photosensitive drum 1*d* onto the intermediary transfer belt 5. However, the application of voltage to the belt pressing roller 96*d* is optional. In a case where voltage is applied to the belt pressing roller 96*d*, the belt pressing roller 96*d* assists the primary transfer roller 9*d* in the transfer of a toner image from the photosensitive drum 1*d* onto the intermediary transfer belt 5, in the primary transfer nip T1*d*. The belt pressing roller 96*d* is practically the same in function as the primary transfer roller 9*d* in the first embodiment, in that it forms the primary transfer nip T1*d* by lifting the intermediary transfer belt 5 in such a manner that even if the tension roller 7 is tilted, the primary transfer nip T1*d* does not change in nip width.

By the way, the primary transfer roller 9*d* may be offset downstream, in terms of the moving direction of the intermediary transfer belt 5, relative to the photosensitive drum 1*d*, between the photosensitive drum 1*d* and belt pressing roller 96*d*, or upstream relative to the photosensitive drum 1*d* in terms of the moving direction of the intermediary transfer belt 5. That is, in this embodiment, with respect to the direction parallel to the circular movement of the belt 5, the transferring component 9*d* to which voltage is applied to form the transfer electric field in the transferring section T1*d* is disposed on the opposite side of the belt pressing component 96*d* from the tiltable roller 7.

Further, in this embodiment, from the standpoint of making the first to fourth image formation units a-d uniform in transfer performance, the primary transfer nips of the first to third image formation units a-c are made the same in structure as the primary transfer nip T1*d* of the fourth image formation unit d. That is, the first to fourth image formation units a-d are practically the same in the positioning and structure of the primary transfer roller and belt pressing roller. However, from the standpoint of preventing the change in the nip width of the primary transfer nip, it will suffice if the fourth image formation unit d is provided with the belt pressing component. Further, in a case where tiltable rollers are disposed as the belt-suspending-tensioning components which double as the deviation controlling components, on the upstream sides of the multiple image formation units a-d, one for one, as shown in FIG. 11, all that is necessary is that the belt pressing roller is disposed on the upstream side of the primary transfer roller of the first image formation unit.

In this embodiment, regardless of the angles of the tension roller 7, the belt pressing roller 96*d* keeps the portion of the intermediary transfer belt 5, which is between the photosensitive drum 1*d* and tension roller 7, protrusive to the photosensitive drum side relative to the straight line T which is tangential to both the peripheral surface of the photosensitive drum 1*d* and the peripheral surface of the tension roller 7. Thus, it does not occur that the portion of the intermediary transfer belt 5, which is between the photosensitive drum 1*d* and belt pressing roller 96*d*, is changed in attitude. Thus, the deviation control unit 70 in this embodiment can prevent the primary transfer nip T1*d* formed by the combination of the photosensitive drum 1*d* and intermediary transfer belt 5, from changing in nip width; it can keep the nip width roughly stable. Therefore, it can more reliably control the belt deviation while preventing the occurrence of the image defects attributable to the change in transfer performance, than any deviation control unit.

Miscellanies

In the foregoing, the present invention was described with reference to the embodiments of the present invention. However, these embodiments are not intended to limit the present invention in scope.

In the embodiments described above, the image forming apparatuses had a transfer unit equipped with an intermediary transferring component. However, the present invention is also applicable to image forming apparatuses having a transfer unit equipped with a transfer medium bearing component. FIG. 12 shows an example of image forming apparatus of the direct transfer type. The elements of the image forming apparatus shown in FIG. 12, which are the same as, or similar to, the counterparts of the image forming apparatus shown in FIG. 3 in function and structure, are given the same referential codes as those given to the counterparts. The image forming apparatus shown in FIG. 12 has a transfer medium bearing belt 105 (conveyer belt), instead of the intermediary transfer belt 5 in the preceding embodiments. The transfer medium bearing belt 105 also is an endless belt. The toner images formed on the photosensitive drums 1*a*-1*d* are sequentially transferred onto a sheet S of transfer medium borne on the transfer medium bearing belt 105 in the transfer nips Ta-Td. The transfer unit 116 equipped with this transfer medium bearing belt 105 has a deviation control unit 70, which is similar to the deviation control unit which the image forming apparatus shown in FIG. 3 has. Therefore, as in the case of the image forming apparatus in FIG. 3, the transfer unit 116 suffers from the same problem as the image forming apparatus in FIG. 3. In particular, the image forming apparatus shown in FIG. 12 suffers from a problem that the transfer nip Td of the fourth image formation unit d changes in nip width. Therefore, a structural arrangement for preventing the change in nip width, which is similar to the one used in the first embodiment, can be applied to the transfer unit 116, at least to the transfer nip Td of the fourth image formation unit d. The effects of the application are the same as those obtainable by the transfer unit 16 in the first embodiment. The concrete structure and operation of the transfer unit 116 are practically the same (intermediary transfer belt in preceding embodiments is to be substituted by transfer bearing belt) as those of the transfer unit 16 in the first embodiment, and therefore, are not described here in order not to repeat the same description. Moreover, the structure of the image forming apparatus of the intermediary transfer type, which was described with reference to FIGS. 10 and 11, may be borrowed as the description of the structure of the image forming apparatus of the direct transfer type shown in FIG. 12.

Moreover, in the preceding embodiments, the belt pressing component was a roller. However, the belt pressing component may be a stationary (in position and movement) component positioned so that an endless belt slides on the component, as long as it can keep the belt protrusive as well as the belt pressing component in the preceding embodiments. For example, it may be in the form of a pad, a brush, a roller-shaped stationary component, etc.

Further, in the above-described embodiments, the belt-suspending-tensioning component (tiltable roller, steering roller) which doubled as the deviation controlling component, was tilted by the deviation controlling components which rotate in contact with the belt. In particular, it was tilted by the mechanism which applies force to the lengthwise ends of the roller. However, the method for tilting the deviation controlling component (one of belt-suspending-tensioning rollers) does not need to be limited to the method in the preceding embodiments. That is, in the preceding embodiments, the deviation controlling component was tilted by moving both of the lengthwise ends of the component to obtain the above-described effects. However, the present invention is also applicable to a transfer unit structured so that only one of the lengthwise ends of the deviation controlling component is moved to tilt the component. Further, the application of the present invention is not limited to a transfer unit structured so that the deviation controlling component (one of belt-suspending-tensioning components) is tilted by a pair of controlling components which are rotated by the belt as the belt comes into contact with the component. That is, regarding the compatibility of the present invention with a given transfer unit, the selection of means for tilting the deviation controlling component is optional. For example, the means may be such a means that determines the direction and amount of belt deviation by detecting a mark placed on the belt (edges, for example), and tilts the deviation controlling component based on the detected amount of belt deviation.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-251319 filed on Dec. 11, 2014, which is hereby incorporated by reference herein in its entirety.

What is claimed is:

1. An image forming apparatus comprising:

an image bearing member configured to carry a toner image;

a transfer unit configured to transfer the toner image from said image bearing member onto a transfer material, said transfer unit including a movable endless belt, a first stretching roller configured to stretch said belt, a second stretching roller configured to stretch said belt, and an adjusting unit configured to adjust movement of said belt in a widthwise direction of said belt by inclining said first stretching roller relative to said second stretching roller, wherein said transfer unit further includes a contacting member provided between said first stretching roller and said image bearing member in a moving direction of said belt and contacting with an inner surface of said belt, said contacting member is supported such that said contacting member contacts the inner surface of said belt at a position in an image bearing member side across a common internal tangent between a surface of said image bearing member and such a portion of a surface of said first stretching roller as is moved closest to said image bearing member by said adjusting unit, the common internal tangent contacting a portion of said image bearing member where said image bearing member contacts said belt and contacting a portion of said first stretching roller where said first stretching roller contacts said belt, and wherein said contacting member is supplied with a voltage to transfer the toner image from said image bearing member toward said belt.

2. An apparatus according to claim 1, wherein said contacting member is disposed at a position away from a contact region between said belt and said image bearing member with respect to the moving direction of said belt.

3. An apparatus according to claim 1, wherein said contacting member contacts an entire widthwise area of said belt irrespective of an amount of inclination of said first stretching roller relative to said second stretching roller.

4. An apparatus according to claim 1, wherein said contacting member includes a metal roller rotatable along with the movement of said belt.

5. An apparatus according to claim 1, wherein said first stretching roller is a tension roller urged by urging means at the inner surface side of said belt toward an outer peripheral surface side thereof.

6. An apparatus according to claim 5, wherein said second stretching roller is a driving roller configured to move the belt.

7. An apparatus according to claim 6, wherein said driving roller and said tension roller provide a stretched belt surface contacted by said image bearing member.

8. An apparatus according to claim 7, further comprising an additional image bearing member configured to carry a different color toner image, wherein said additional image bearing member contacts said stretched belt surface and is disposed at a position further from said tension roller than said image bearing member.

9. An apparatus according to claim 1, wherein said adjusting unit synchronously moves opposite axial end portions of said first stretching roller in opposite directions from each other.

10. An apparatus according to claim 1, wherein said belt is an intermediary transfer belt configured to receive the toner image from said image bearing member by primary-transfer.

11. An apparatus according to claim 1, wherein said belt is a feeding belt configured to feed a transfer material for receiving the toner image from said image bearing member.

* * * * *